US005751095A

United States Patent [19]

Zalar

[11] Patent Number: 5,751,095

[45] Date of Patent: May 12, 1998

[54] SIMULATED REFLECTOR LAMP USING PAR LAMP COMPONENTS

[75] Inventor: Frank E. Zalar, Willoughby Hills, Ohio

[73] Assignee: General Electric Company, Schenectady, N.Y.

[21] Appl. No.: 510,756

[22] Filed: Aug. 3, 1995

Related U.S. Application Data

[63] Continuation of Ser. No. 134,038, Oct. 8, 1993, abandoned.

[51] Int. Cl.[6] ..... H01J 5/48; H01J 5/16

[52] U.S. Cl. ..... 313/113; 439/611

[58] Field of Search ..... 439/604, 605, 439/606, 611, 615, 619; 362/310, 211, 296, 347, 350; 313/452, 113, 116, 580, 579, 573, 578, 315, 317, 634, 635, 636, 270

[56] References Cited

U.S. PATENT DOCUMENTS

| | | | |
|---|---|---|---|
| 2,017,733 | 10/1935 | Sakakura | 313/116 |
| 4,243,907 | 1/1981 | Kohl et al. | 313/318.07 |
| 4,864,184 | 9/1989 | Fleming | 439/611 |
| 4,877,992 | 10/1989 | Devir | 313/318.07 |
| 5,039,909 | 8/1991 | Kieshivey et al. | 439/611 |
| 5,045,748 | 9/1991 | Ahlgren et al. | 313/579 |
| 5,057,735 | 10/1991 | Zalar et al. | 313/580 |
| 5,216,318 | 6/1993 | Van Dulmen et al. | 313/318.03 |
| 5,420,474 | 5/1995 | Schmitt, Jr. et al. | 439/611 |

FOREIGN PATENT DOCUMENTS

| | | | |
|---|---|---|---|
| 250509 | 11/1966 | Austria | 362/211 |
| 1064914 | 5/1954 | France | 362/211 |
| 4206436A | 7/1992 | Japan | 313/635 |

*Primary Examiner*—Thomas D. Lee
*Assistant Examiner*—Jerome Grant, II
*Attorney, Agent, or Firm*—George E. Hawranko

[57] ABSTRACT

A reflector lamp unit is provided having a light source which is capable of meeting the efficiency requirements mandated by law. The reflector lamp unit includes a pressed glass reflector member having a curved portion and a lower neck portion on which is secured a conventional threaded screw base. The light source can be a high efficiency light source such as a discharge light source of a tungsten-halogen light source contained within a pressurized lamp envelope. The light source is disposed within the curved portion of the reflector member at a position along the longitudinal axis and ahead of the optical focal point of the reflector. In this manner, a beam pattern is generated which is widely scattered and unfocused as compared to that beam pattern which would be produced from a light source disposed at the focal point. The reflective surface of the curved portion of the reflector member is lightly roughened thereby resulting in an increased diffusion characteristic of the beam pattern. A spacer member is disposed within the lower portion of the reflector member to provide both a means for enclosing the inner space of the reflector and for providing support for the light source.

15 Claims, 2 Drawing Sheets

SIMULATED REFLECTOR LAMP USING PAR LAMP COMPONENTS

This application is a continuation of application Ser. No. 08/134,038, filed Oct. 8, 1993, now abandoned.

FIELD OF THE INVENTION

This invention relates to a reflector lamp configuration which is achieved using components constructed for use with parabolic aluminized reflector (PAR) lamps. More particularly, this invention relates to such a reflector lamp which utilizes PAR configured components so as to achieve improved energy efficiency properties yet simultaneously, provide the same beam pattern output as a lamp which utilizes conventional reflector lamp components.

BACKGROUND OF THE INVENTION

Reflector ("R") lamps and PAR lamps are commonly used in various commercial, industrial and residential lighting applications depending on the specific beam performance characteristics desired. For instance, although both types of lamps can provide typical floodlight or spotlight performance in both outdoor as well as indoor environments and at short to medium distances, it is known that the PAR type of lamp is more efficient and provides a tighter, more defined beam pattern with much higher center beam and/or peak CP (e.g. candle power) than an R lamp and is therefore utilized in display and accent applications. R lamps on the other hand are utilized in applications where it is desired to have a more diffuse, wider beam pattern and thus finds more general acceptance in residential applications. Regardless of the application, however, by October, 1995 both types of lamps will be subjected to the requirements of recently enacted legislation mandating an improvement in the efficacy (e.g. lumens per watt—"lpw") of certain lighting products. Specifically, the Energy Policy Act of 1992 has set certain limits, which in the case of the R lamp, will preclude the use of a conventional C-7 type of filament typically utilized as the means for generating light output. Instead of a bare filament disposed within a blown reflector envelope as is the present configuration for an R lamp, lighting manufacturers must substitute a more energy efficient light source. An example of such a light source is described in U.S. Pat. No. 4,959,583 issued to Arsena et al on Sep. 25, 1990 and issued to the same assignee as the present invention wherein a tungsten halogen light source is utilized in a compact PAR lamp. Of course, a further more efficient light source would be one wherein the tungsten halogen light source had an interference coating disposed thereon so as to reflect infrared radiation back upon the filament to thereby improve the efficiency. Such a halogen-IR light source is presently available from General Electric Company's Lighting Business in a variety of products including PAR lamps. Further examples of tungsten halogen light sources used in conjunction with PAR lamps can be found in U.S. Pat. Nos. 4,829,210 and 5,057,735. In each of these patents, a tungsten halogen lamp is mounted within a pressed glass PAR reflector having a cover member disposed thereover.

Although in theory the concept of inserting into a blown glass reflector envelope, a tungsten halogen light source including the hollow cylindrical lamp envelope associated therewith, seems prudent for purposes of improving the energy efficiency of an R lamp, because such a light source is contained within a pressurized lamp envelope, safety considerations dictate that this type of light source can not be utilized in a typical glass reflector of an R lamp.

Accordingly, it would be desirable to provide an alternate configuration for conventional R lamps that would meet the necessary energy efficiency levels required by the Energy Policy Act of 1992 and yet still provide the wider, more diffuse beam pattern of an R lamp. In other words, given that PAR lamps as shown in the previously referenced U.S. Pat. No. 4,959,583 can meet the energy efficiency levels required, it would be advantageous if a configuration could be provided that would render R lamps compliant with the Act and therefore avoid the possibility of eliminating R lamps from the marketplace entirely.

One approach to improving the energy efficiency of existing R lamps would be to include as an additive to the fill material contained within the blown glass reflector, an amount of the rare gas Krypton. It is known in the art that such a modification will achieve improved energy efficiency using existing filament structures; however, this modification is limited in the practical sense for commercial reasons. The rare gas Krypton is expensive and would be required in such large quantities particularly at higher wattage R lamp products, that to rely on this approach would render the resultant product commercial non-viable. Therefore, although adding krypton would be potentially effective in improving the energy efficiency of a conventional R lamp, it would be more advantageous to provide an improved energy efficiency approach that was more cost effective thus insuring the continued market acceptance of such an R lamp.

SUMMARY OF THE INVENTION

The present invention provides an alternate configuration for achieving the performance of a conventional R lamp while also attaining improved energy efficiency so as to meet the requirements of the Energy Policy Act of 1992. Moreover, the present invention achieves such an alternate configuration by utilizing techniques which are cost effective thereby insuring market acceptance of such alternative, energy efficient R lamp.

In accordance with the principles of the present invention, there is provided a reflector lamp unit which includes an energy efficient light source contained within a pressurized lamp envelope and a reflector member configured having a curved upper portion terminating in an open end, and a longitudinally extending lower portion. The reflector member has a reflective coating disposed thereon and has an optical focal point associated with the curved portion thereof. An electrically conductive screw base is mounted on the lower portion of the reflector and is in electrically coupled relation to the light source so as to enable energization of the light source. A light transmissive cover member is disposed over the open end of the reflector member. The pressurized lamp envelope is accurately mounted along the longitudinal axis of the reflector member at a position that places the light source between the optical focal point and the open end of the curved portion of the reflector member. By precisely positioning the light source ahead of the optical focal point, the reflector lamp achieves a beam pattern light output which is wide and unfocused in comparison to a beam pattern as would be output if the light source were disposed at the focal point. This wide and unfocused beam pattern can then be further smoothed with a lens cover member thereby accurately simulating the light output of an R lamp.

In one embodiment of the invention, the reflective coating of the reflector member is lightly roughened or textured so that the resultant beam pattern light output is made more diffuse and further simulates an R lamp beam pattern light output.

BRIEF DESCRIPTION OF THE INVENTION

In the following detailed description, reference will be made to the attached drawings in which.

DETAILED DESCRIPTION OF THE INVENTION

Figure 1:
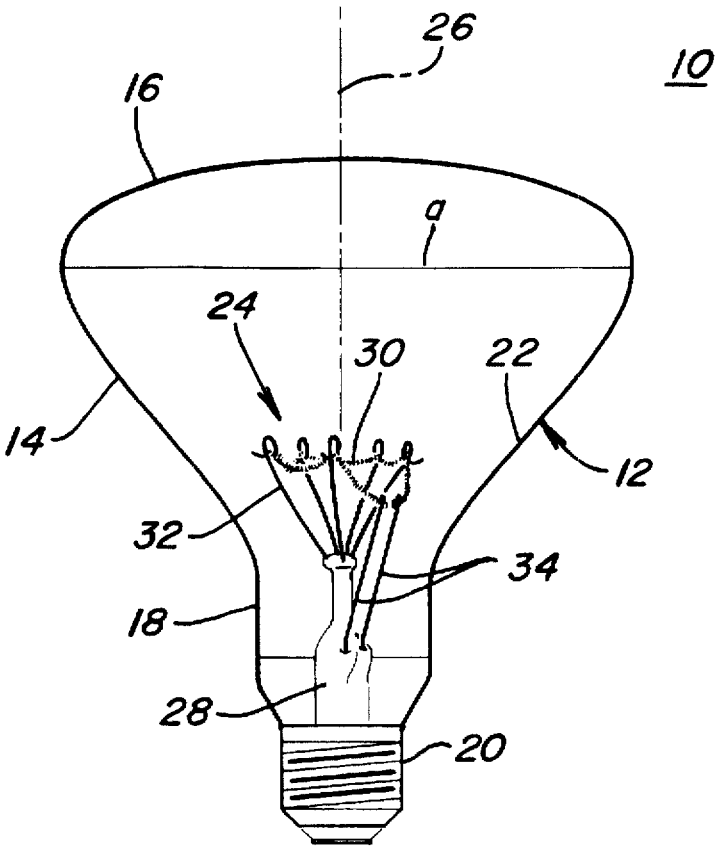
Fig. 1 (PRIOR ART)
FIG. 1 is an elevational view in section of a conventional R lamp constructed in accordance with prior art teachings.

As seen in FIG. 1, an R lamp 10 constructed in a conventional configuration, includes a blown glass reflector member 12 having a curved reflector portion 14 closed by an integral flattened face portion 16 having less curvature than reflector portion 14. Reflector member 12 also includes a longitudinally extending neck portion 18 which tapers so as to allow mounting of a screw base member 20. For a conventional R lamp 10 such as shown in FIG. 1, a reflective coating 22 is disposed on a portion of the inner surface primarily defined by the curved reflector portion 14 and a portion of the neck portion 18; the flattened face portion 16 which has no reflective coating thereon, is defined by the dividing line a shown in FIG. 1.

A filament/support structure 24 is disposed within reflector member 12 substantially along the longitudinal axis 26 thereof. The filament/support structure 24 is one typically referred to as a C-7A filament and includes a glass support member 28 on which a looped filament 30 is mounted. Support wires 32 extending from the top portion of glass support member 28 support filament 30 at various points along the length thereof. The ends of filament member 30 are connected to lead wires 34 which are in turn electrically connected to the screw base member 20 in a conventional manner so as to allow for the energization of the filament 30. In such a conventional R lamp 10, the filament 30 is disposed at approximately the focal point of the curved reflector portion 14 so as to provide the necessary beam pattern light output desired for the R lamp.

It is to be understood that the R lamp 10 of FIG. 1 is illustrational of the conventional construction for such a lamp; however, there are a variety of different configurations that can be provided. For instance, rather than a C-7A filament structure, it would be possible to utilize a different filament structure for an R lamp having a different power rating requirement. Additionally, some conventional R lamps can have multiple curved portions on the reflector member; for instance, see the reflector lamp illustrated in FIG. 5 of U.S. Pat. No. 4,494,176 issued to Sands et al on Jan. 15, 1985, assigned to the same assignee as the present invention, and hereby incorporated by reference.

Each of the examples of conventional types of R lamps utilizes a blown glass reflector member which can be mass produced typically on an automated high speed glass ribbon machine using a process such as described in U.S. Pat. No. 4,569,867 issued to Raymond J. Noe on Feb. 11, 1986 and assigned to the same assignee as the present invention. Though such a blown glass reflector member has proven acceptable for use with a light source such as the filament structure 24 of FIG. 1, because of the requirements of enacted energy legislation, such a light source cannot meet the efficacy requirements to be effective as of Oct. 31, 1995. In fact, a more energy efficient light source such as a tungsten halogen light source would have to be substituted for use in R lamps in order to meet the necessary efficacy constraints. Unfortunately, because such a light source is provided in a pressurized envelope, given that the blown glass reflector member is constructed of a thin gauge of glass as compared to a pressed glass reflector as is typically used on a PAR lamp for instance, safety considerations preclude the use of the combination of a pressurized lamp envelope in a thin gauge blown glass reflector.

Figure 2:
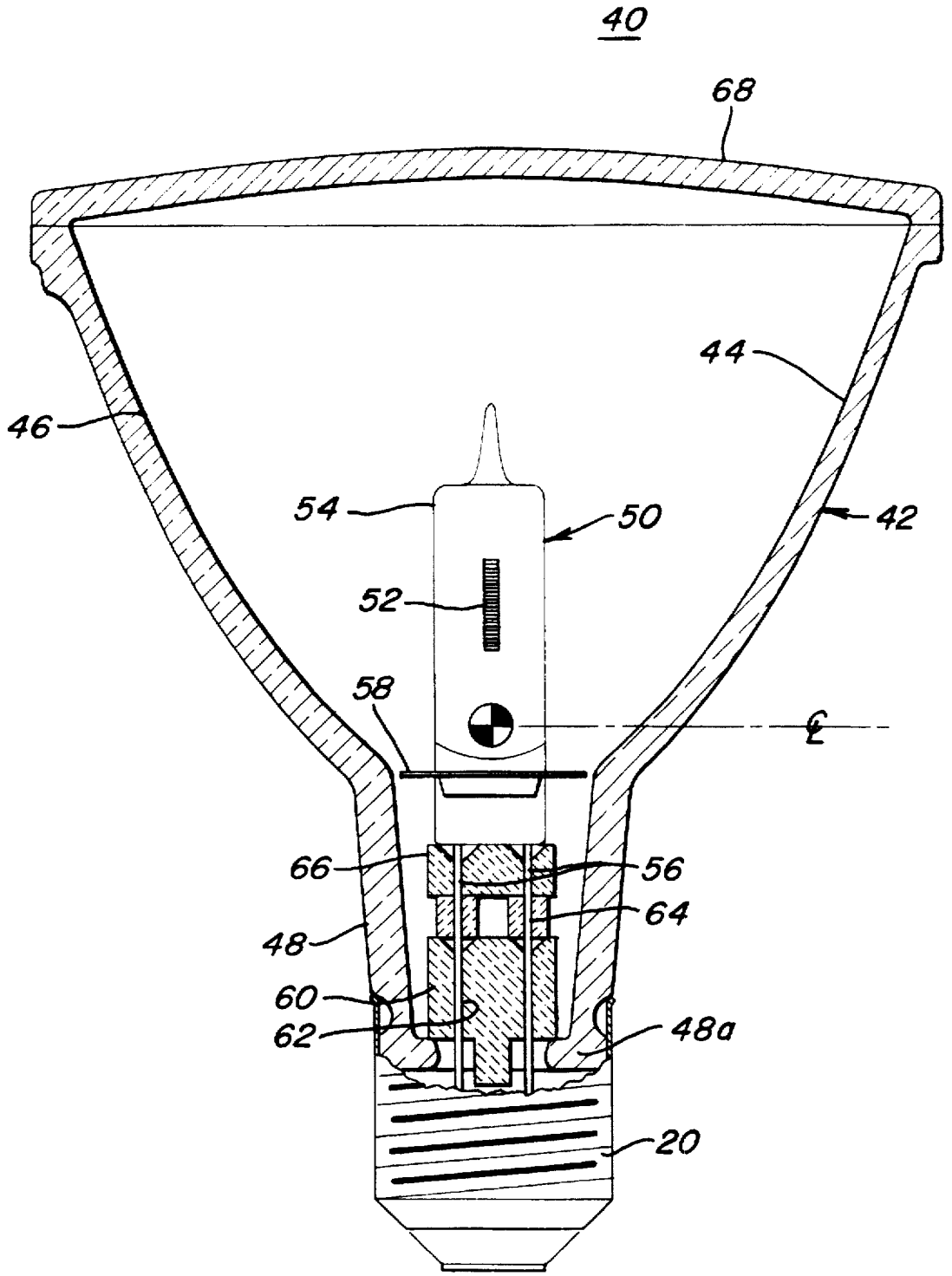
FIG. 2 is an elevational view in section of an R lamp constructed in accordance with the teachings of the present invention.

As seen in FIG. 2, an R lamp 40 is achieved using a reflector member 42 which is constructed having a pressed glass configuration similar to that of a PAR lamp. In fact, for the purpose of cost efficiency, it would be possible to use a PAR reflector member to achieve the present R lamp 40 without having to manufacture and stock separate components. Such dual utilization of common components results in savings from avoiding the need to implement costly new automated equipment to manufacture a separate component and, from reducing the amount of inventory needed to manufacture the resultant PAR and R lamp end products. Reflector member 42 has a reflective coating 44 disposed in the inner surface thereof. The reflective surface 44 can be a silver, aluminum or dichroic type of coating and can be applied using conventional techniques.

Reflector member 42 is constructed of an integral body having an upper curved portion 46 which is preferably shaped in a parabolic manner, and a lower portion 48 tapered into a narrow end region **48*a* on which screw base 20 is secured. Screw base 20 can be of a conventional edison type so as to allow insertion into ordinary fixtures. Preferably, the reflective coating 44 disposed on the inner surface of reflector member 42 need not extend entirely into the lower portion 48 and the end portion 48*a*. Appropriate openings are formed at the end region 48*a* to allow for electrical coupling and for filling the inner space of the reflector lamp 40** with a fill-gas if necessary.

R lamp 40 includes a light source 50 capable of meeting the efficacy requirements required by law. The light source 50 can be a tungsten halogen lamp having a coiled tungsten filament 52 disposed within a pressurized lamp envelope 54 having a halogen compound contained therein. Additionally, the light source 50 may be of a tungsten halogen type which includes an interference coating disposed on the lamp envelope 54 effective so as to reflect infrared radiation back towards the filament 52 and improve efficiency thereby; such a light source is referred to as a Halogen-IR light source. A further example of a suitable light source for R lamp 40 of the present invention would be a discharge type of light source which would also meet the efficacy requirements necessary. A discharge light source, rather than having a filament disposed approximately at the position shown by filament 52 in FIG. 2, would comprise an arc discharge occupying such space. Light source 50 typically will have a pair of leads 56 extending from the bottom portion thereof so as to be coupled to the screw base 20 thereby allowing energization of the light source 50. A reflective disk member 58 may be disposed around a pinch seal region **50*a* of the light source 50 so that the amount of light lost through the lower region 48 of the reflector member 42, can be minimized. The reflective disk member 58 can also be effective for redirecting heat that would otherwise flow into the lower region 48 of the reflector 42 and is typically located at the transition point between the curved portion 46 and the bottom portion 48 of the reflector member 42**.

As seen in FIG. 2, the optical focal point, designated f, resides at a point substantially below the midpoint of the filament 52, or in the case of a discharge lamp, below the arc discharge. In other words, the light generating device, whether a filament 52, or an arc discharge, will reside at a point ahead of the optical focal point f, associated with the reflector member 42. In this manner, the characteristics of the beam pattern output from reflector lamp 40 will be widely scattered and unfocused as compared to that beam pattern associated with a PAR lamp and which can be accomplished by disposing the light source 50 at the optical focal point f. In addition to scattering the beam pattern by displacing the light source 50 relative to the optical focal point f, the present invention further simulates an R lamp beam pattern by diffusing the light beam as well. This diffusion characteristic of the beam pattern is achieved by lightly roughening the reflective surface of the curved portion 46 of reflector member 42. By providing such a widely scattered and diffused beam pattern, the reflector lamp 40 of the present invention effectively simulates the performance of a conventional reflector lamp but does so using a light source which will meet the energy efficiency levels required by law and using a reflector member 42 which can be safely used in conjunction with a pressurized light source 50 such as provided herein.

A spacer member 60 is provided as a means for supporting the light source 50 against movement away from the position whereby the optimal reflector lamp properties are achieved, and for enclosing the open end 48*a* of the reflector member 42. Spacer member 60 includes a narrow portion 62 which is sized so as to be just larger than the diameter of leads 56 thereby providing support for a substantial length of lead members 56. Spacer member 60 further includes a beveled portion which allows for easy insertion of lead members 56 therethrough. Spacer member 60 can extend the length of the lower portion 48 of the reflector member 42, or it can be provided by means of stages of spacer members as seen by elements 64 and 66. By use of an appropriate securing arrangement (not shown), spacer member 60, in conjunction with a cover member 68 secured to the open end of reflector member 42, can effectively provide an enclosed chamber around light source 50. Cover member 68 is also effective by selection of an appropriate prism configuration for further smoothing of the light output.

Although the hereinabove described embodiment constitutes the preferred embodiment of the invention, it can be appreciated that modifications can be made thereto without departing from the scope of the invention as set forth in the appended claims. For instance, the light source 50 can be mounted transverse to the longitudinal axis and still achieve the benefits of the present invention.

I claim:

1. A reflector lamp unit comprising:

a light source contained within a pressurized lamp envelope, said light source having lead members extending therefrom;

a reflector member configured so as to have a curved upper portion terminating at an open end, and a longitudinally extending lower portion, said reflector member having a reflective coating disposed thereon and having an optical focal point associated with the curved portion thereof;

an electrically conductive screw base disposed on said lower portion of said reflective member, said light source being electrically coupled to said screw base so as to enable energization of said light source;

a light transmissive cover member disposed over said open end of said reflector member;

wherein said pressurized lamp envelope is mounted along the longitudinal axis of said reflector member such that said light source is at a position between said optical focal point and said open end of said reflector member effective for providing a controlled divergence beam pattern light output which is wide and unfocused in relation to a narrow, focused beam pattern light output as occurs when said light source is positioned at said optical focal point; and, a spacer member disposed within said lower portion of said reflector member, said spacer member having throughbores formed therein through which said lead members extend.

2. A reflector lamp unit as set forth in claim 1, wherein said light source is positioned an effective distance from said optical focal point to simulate an R lamp.

3. A reflector lamp unit as set forth in claim 1 wherein said light source is an arc discharge light source.

4. A reflector lamp unit as set forth in claim 1 wherein said reflective coating disposed on said curved portion of said reflector member is roughened in texture so as to produce a diffuse light beam pattern reflected therefrom.

5. A reflector lamp unit as set forth in claim 1 wherein said reflector member and said cover member are similarly constructed of pressed glass.

6. A reflector lamp unit as set forth in claim 1 wherein said throughbores are sized so as to surround a portion of said lead members in close proximity thereby providing support to said light source.

7. A reflector lamp unit as set forth in claim 1, wherein said spacer member is comprised of two separate spacer elements.

8. A reflector lamp unit as set forth in claim 1, wherein a center of said light source is positioned between said optical focal point and said open end of said reflector member.

9. A reflector lamp unit as set forth in claim 8, wherein said light source is an arc discharge type and an arc discharge is positioned between said optical focal point and said open end of said reflector lamp.

10. A reflector lamp unit as set forth in claim 1 wherein said light source is a tungsten-halogen light source comprising a tungsten filament disposed within said pressurized lamp envelope which contains a halogen compound therein.

11. A reflector lamp unit as set forth in claim 10, wherein a center of said tungsten filament is positioned between said optical focal point and said open end of said reflector member.

12. A reflector lamp unit as set forth in claim 11, wherein said entire tungsten filament is positioned between said optical focal point and said open end of said reflector lamp.

13. A reflector lamp unit as set forth in claim 10 further comprising an interference coating disposed on at least a portion of said lamp envelope, said interference coating being effective so that infrared radiation generated by said light source is reflected back onto said tungsten filament.

14. A reflector lamp unit comprising:

a light source contained within a pressurized lamp envelope, said light source having lead members extending therefrom;

a reflector member configured so as to have a curved upper portion terminating at an open end, and a longitudinally extending lower portion, said reflector member having a reflective coating disposed thereon and having an optical focal point associated with the curved portion thereof;

an electrically conductive screw base disposed on said lower portion of said reflective member, said light source being electrically coupled to said screw base so as to enable energization of said light source;

a light transmissive cover member disposed over said open end of said reflector member;

wherein said pressurized lamp envelope is mounted along the longitudinal axis of said reflector member such that said light source is at a position between said optical focal point and said open end of said reflector member effective for providing a controlled divergence beam pattern light output which is wide and unfocused in relation to a narrow, beam pattern light output as occurs when said light source is positioned at said optical focal point; and, a reflective disk member disposed around a pinch seal region of the light source and positioned at a transition point between the curved upper portion and the longitudinally extending lower portion of the reflector member.

15. A reflector lamp unit comprising:

a light source contained within a pressurized lamp envelope, said light source having lead members extending therefrom;

a reflector member configured so as to have a curved upper portion terminating at an open end, and a longitudinally extending lower portion, said reflector member having a reflective coating disposed thereon and having an optical focal point associated with the curved portion thereof;

an electrically conductive screw base disposed on said lower portion of said reflective member, said light source being electrically coupled to said screw base so as to enable energization of said light source;

a light transmissive cover member disposed over said open end of said reflector member;

wherein said pressurized lamp envelope is mounted along the longitudinal axis of said reflector member such that said light source is at a position between said optical focal point and said open end of said reflector member effective for providing a controlled divergence beam pattern light output which is wide and unfocused in relation to a narrow, beam pattern light output as occurs when said light source is positioned at said optical focal point; and, a multi-stage spacer member disposed in surrounding relation to a substantial portion of said lead members, said spacer member providing support for said lead members and further having at least one segment which can be varied in length.

* * * * *